US008758037B2

(12) United States Patent
Chang et al.

(10) Patent No.: US 8,758,037 B2
(45) Date of Patent: Jun. 24, 2014

(54) ELECTRIC SOCKET AND BEARING BODY THEREFOR

(75) Inventors: Ya-Han Chang, New Taipei (TW); Yung-Shun Kao, New Taipei (TW)

(73) Assignee: Giga-Byte Technology Co., Ltd., New Taipei (TW)

( * ) Notice: Subject to any disclaimer, the term of this patent is extended or adjusted under 35 U.S.C. 154(b) by 45 days.

(21) Appl. No.: 13/409,896

(22) Filed: Mar. 1, 2012

(65) Prior Publication Data

US 2012/0322291 A1 Dec. 20, 2012

(30) Foreign Application Priority Data

Jun. 15, 2011 (TW) ..... 100120795 A

(51) Int. Cl.
*H01R 13/627* (2006.01)
*H01R 13/62* (2006.01)

(52) U.S. Cl.
CPC ..... *H01R 13/62* (2013.01)
USPC ..... 439/354; 439/680

(58) Field of Classification Search
USPC ..... 439/353, 354, 680
See application file for complete search history.

(56) References Cited

U.S. PATENT DOCUMENTS

| | | | | | |
|---|---|---|---|---|---|
| 5,389,006 | A * | 2/1995 | Noschese | 439/354 |
| 5,391,090 | A * | 2/1995 | Power | 439/354 |
| 5,613,881 | A * | 3/1997 | Ichida et al. | 439/680 |
| 6,319,068 | B1 * | 11/2001 | Bao | 439/660 |
| D501,829 | S * | 2/2005 | Kimura et al. | D13/147 |
| 7,223,114 | B2 * | 5/2007 | Tateishi et al. | 439/354 |
| 7,559,791 | B1 * | 7/2009 | Kao et al. | 439/491 |
| 2012/0322291 | A1 * | 12/2012 | Chang et al. | 439/345 |

FOREIGN PATENT DOCUMENTS

| | | |
|---|---|---|
| TW | 127482 | 9/1977 |
| TW | M361157 | 9/1997 |
| TW | 501312 | 9/2002 |
| TW | I342640 | 5/2011 |

* cited by examiner

*Primary Examiner* — James Harvey
(74) *Attorney, Agent, or Firm* — Chun-Ming Shih

(57) ABSTRACT

The invention provides an electric socket and a bearing body therefor. The bearing body includes a housing for accommodating the electrically connecting terminal, having a plurality of sidewalls that are connected and a bottom; a baffled portion on one of the sidewalls; a rib provided on the sidewall and extending longitudinally from one side to the other side of the one of the sidewalls; and a plurality of conductive pins penetrating the bottom. When the electrically connecting terminal is fit into the housing, the baffled portion opposes against the fastener of the electrically connecting terminal, and the rib is located against an outer surface of the electrically connecting terminal, thereby preventing detachment of the electrically connecting terminal from the electric socket.

10 Claims, 22 Drawing Sheets

ELECTRIC SOCKET AND BEARING BODY THEREFOR

CROSS-REFERENCE OF RELATED APPLICATIONS

This application claims the benefit of the priority of Taiwan Patent Application No. TW 100120795, entitled "ELECTRIC SOCKET AND BEARING BODY THEREFOR", filed on Jun. 15, 2011, the entirety of which is incorporated herein by reference.

BACKGROUND OF THE INVENTION

1. Field of the Invention

The invention relates to an electric socket and a bearing body for the electric socket, particularly relates to an electric socket capable of preventing slip, loose connection, or detachment of an electrically connecting terminal therefrom and a bearing for the electric socket.

2. Description of the Prior Art

As the technology greatly advances, the trend for most high-tech products is moving towards powerful function, miniaturization, and easy extendibility. In order to connect with modern peripherals, there are many different types of electric connectors on circuit boards of electronic products.

The electric connector that is widely used as a connecting device in an electronic product has a function of collecting wires. The wires are conveniently connected each other or to circuits with an electrically connecting terminal being plugged into an electric socket. In this way, the electronic products may be electrically connected to the peripheral devices to and from which the control signals are output or the data is transmitted.

Therefore, most of the current circuits are provided with connectors having extendibility and electrical connection ability. Transmission speed for the connectors is continuously improved for keeping up with the need of this generation, and the size thereof is getting larger and larger. For example, when the USB specification was moved from version 2.0 to 3.0, the number of pins got a one-fold increase for providing a higher transmission speed. However, as the size of the connectors is increased due to the increased pin number, the dimension of electrically connecting terminals and electric sockets is increased correspondingly either in length or in width. For this reason, the force acting upon the connecting terminals tends to be not uniform, thus the connecting terminals cannot combine stably and firmly with the electric sockets. Under this condition, unstable transmission between the electronic devices and the peripherals may occur, thereby causing the damage thereto.

SUMMARY OF THE INVENTION

In view of the forgoing problem, the invention discloses an electric socket and a bearing body for the electric socket, both of which are capable of keeping the connecting terminals from loose connection, slip, or detachment. They solve the conventional problem by preventing the damage to the electronic devices and peripherals.

The electric socket of the invention is fit for the connecting terminal having a fastener and a guide bump on an outer surface thereof. The electric socket includes a housing for accommodating the electrically connecting terminal, having a plurality of sidewalls and a bottom; a baffled portion located corresponding to the fastener on a first sidewall of the plurality of the sidewalls and configured to be engaged with the fastener; a rib provided on the first sidewall or a second sidewall of the sidewalls that is opposite to the first sidewall or a third sidewall of the sidewalls that is adjoining to the first sidewall, the rib extending longitudinally from one side to the other side of the first or the second or the third sidewall and being configured to oppose against the outer surface of the electrically connecting terminal; and a plurality of conductive pins penetrating the bottom and electrically connecting to the electrically connecting terminal.

The bearing body for the electric socket of the invention comprises a housing having a plurality of sidewalls and a bottom, the housing accommodating the electrically connecting terminal; a baffled portion on the first sidewall; and a rib provided on the first sidewall or a second sidewall of the sidewalls that is opposite to the first sidewall or a third sidewall of the sidewalls that is adjoining to the first sidewall, the rib extending longitudinally from one side to the other side of the first or the second or the third sidewall.

The object of the invention can be achieved by providing an electric socket and a bearing body therefor that are capable of binding the connecting terminal to the electric socket firmly by way of the baffled portion and the rib. Among them, because the rib helps with increase of the contact area between the electric socket and the connecting terminal, the friction therebetween is also increased. This further prevents the detachment of the connecting terminal from the electric socket.

The characteristics, realization and functions of the invention are disclosed in the following description with reference to the preferred exemplified embodiments and the accompanying drawings.

DETAILED DESCRIPTION OF THE INVENTION

Figure 1:
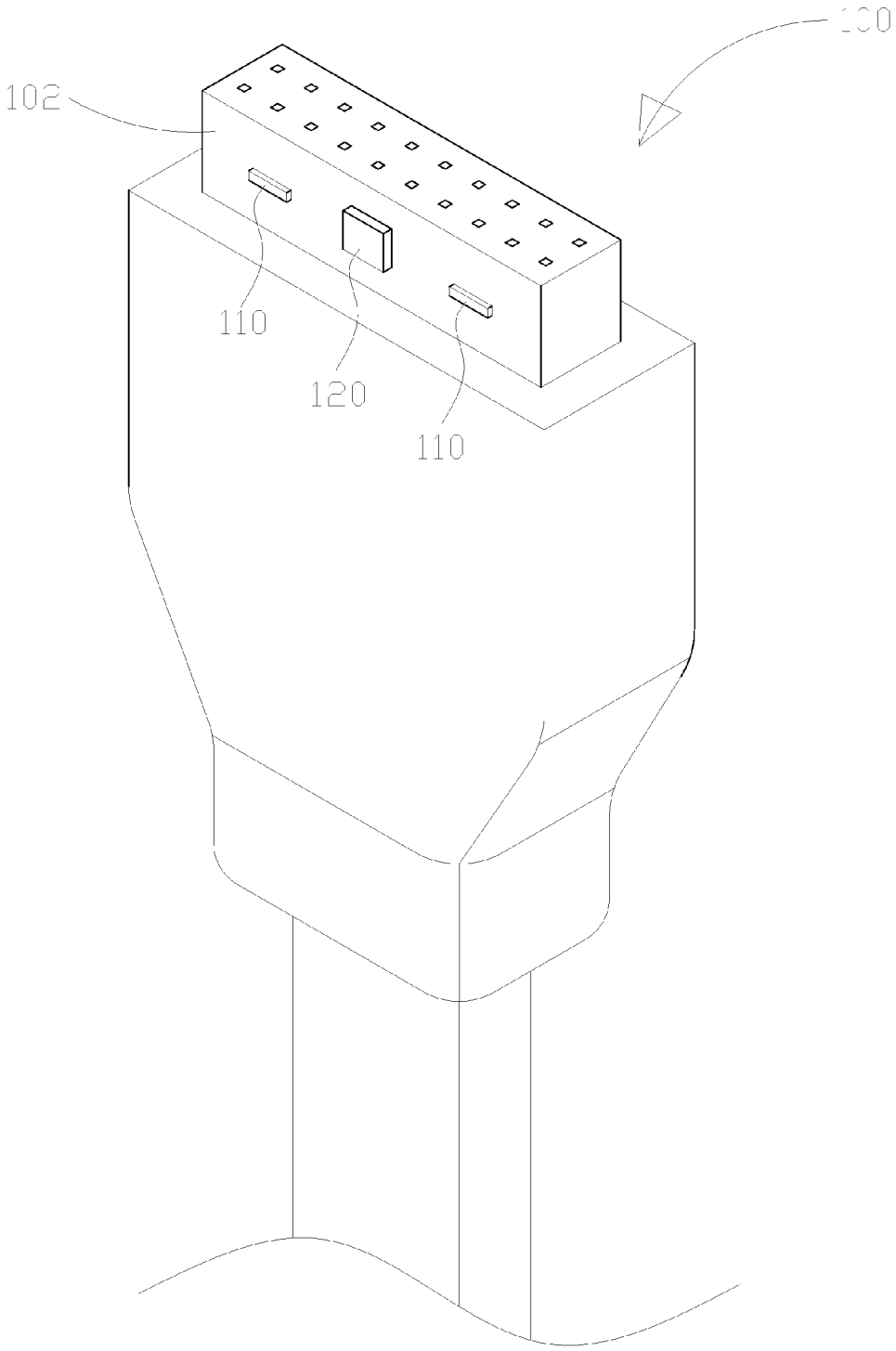
FIG. 1 is a schematic view showing the structure of an electrically connecting terminal in a first preferred embodiment of the invention.
Figure 2A:
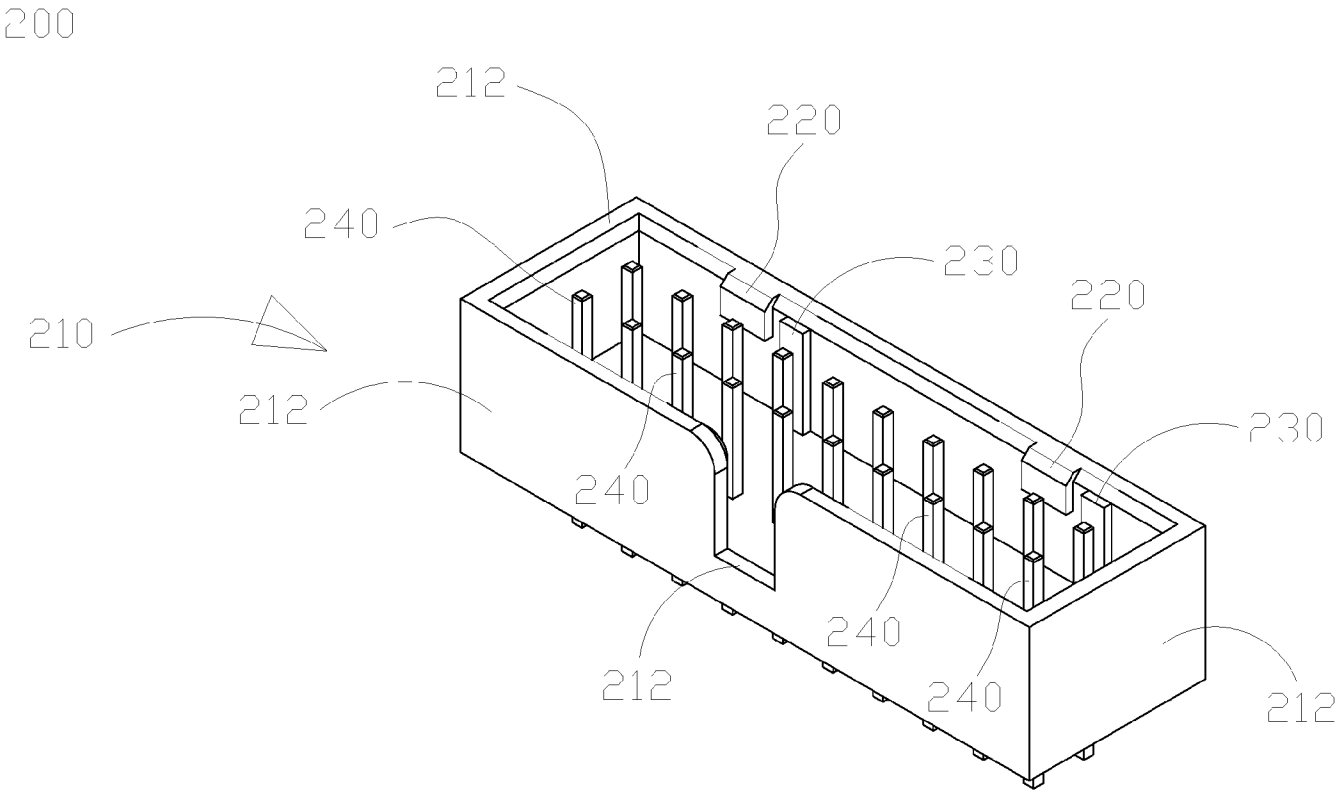
FIG. 2A is a three-dimensional view showing an electronic socket in a first preferred embodiment of the invention.
Figure 2B:
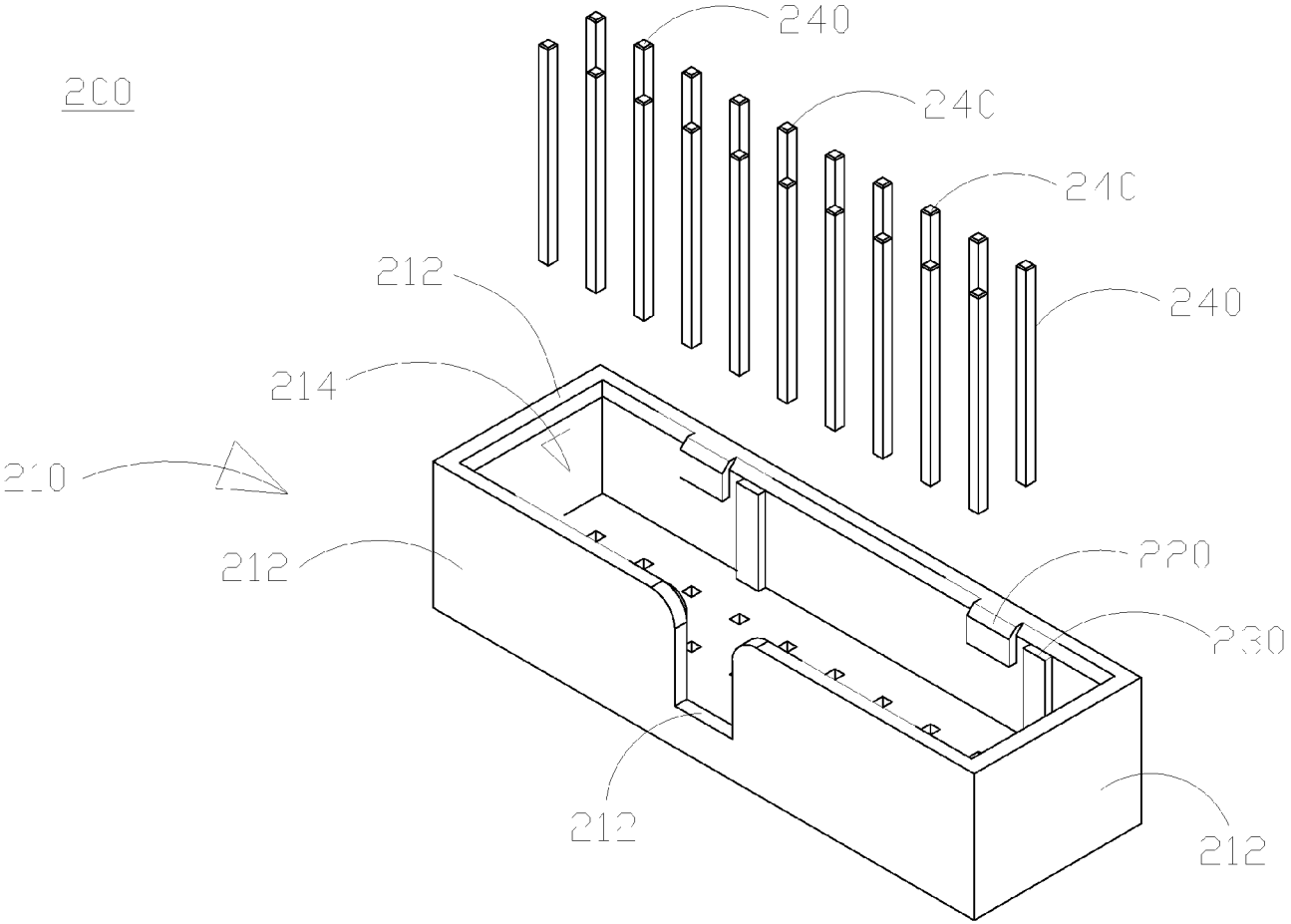
FIG. 2B is a three-dimensional view showing the electronic socket in the first preferred embodiment of the invention.
Figure 2C:
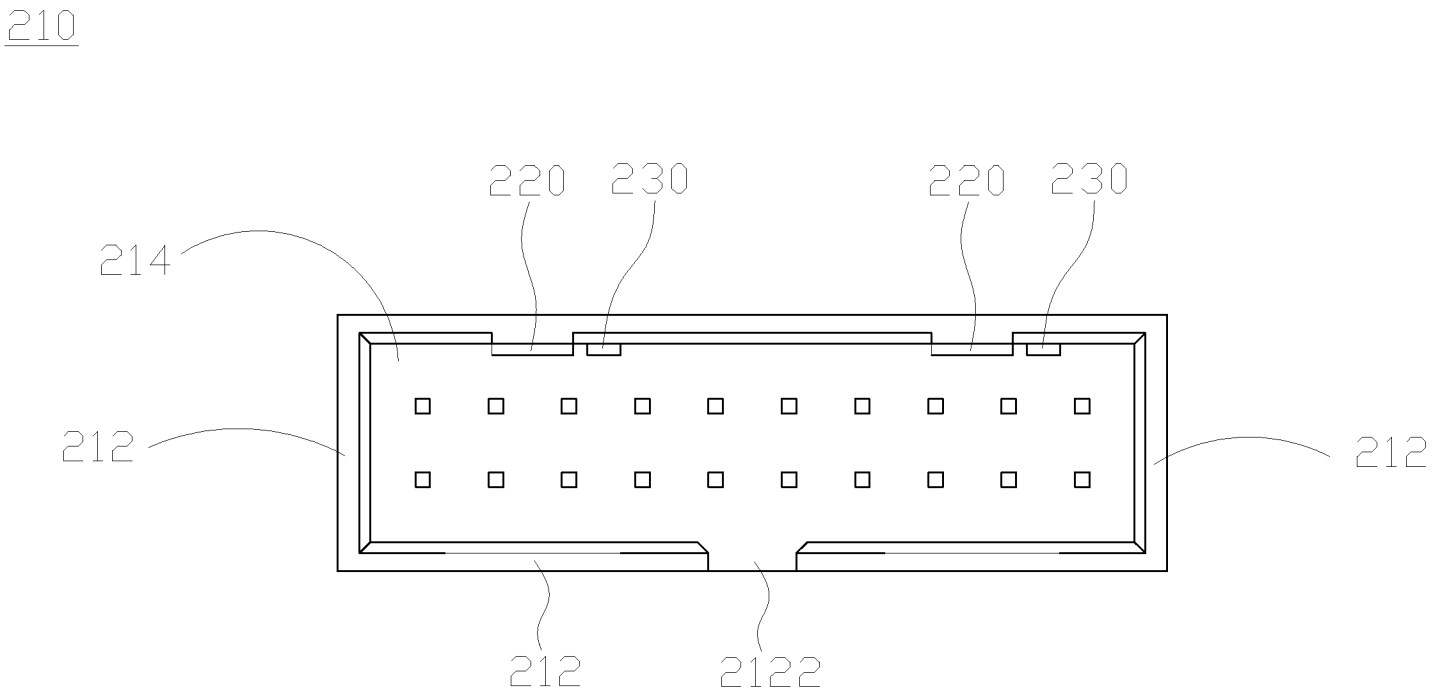
FIG. 2C is a three-dimensional view showing the bearing body of the electric socket in a first preferred embodiment of the invention.

FIGS. 1 and 2A-2C are respectively a schematic view showing the structure of the electrically connecting terminal, a three-dimensional view and an exploded view of the electric socket, and a bearing body of the electric socket of a first preferred embodiment of the invention.

As shown in the figures, the electric socket 200 of the invention is fit for an electrically connecting terminal 100 having a fastener 110 and a guide bump 120 on an outer surface 102 thereof. The electric socket 200 includes a housing 210, a baffled portion 220, a rib 230, and a plurality of conductive pins 240. The housing 210 is surrounded by multiple sidewalls 212 and a housing 214 is formed therein for accommodating connecting terminals 100. The baffled portion 220 is provided on a sidewall at a position corresponding to the fastener 110. In this embodiment, two baffled portions 220 are formed in an electric socket for illustration.

The rib 230 is provided on the same sidewall that the baffled portion 220 is disposed and is adjacent to the baffled portion 220 in this embodiment. Besides, the rib 230 crosses this sidewall 212 in a longitudinal direction, i.e. extends longitudinally from the upper side to the lower side of this sidewall 212. Further, the rib 213 is disposed correspondingly to the baffled portion 220 not only in the position but also in the number (two in this example). The plurality of conductive pins 240 penetrate into the bottom of the housing 210, and are configured to electrically connect to the connecting terminal 100. A recess 2122 is formed correspondingly on one of the sidewalls of the housing 210 for facilitating the slide of the guide bump 120 when the connecting terminal 100 is fit into the housing 210.

Figure 3A:
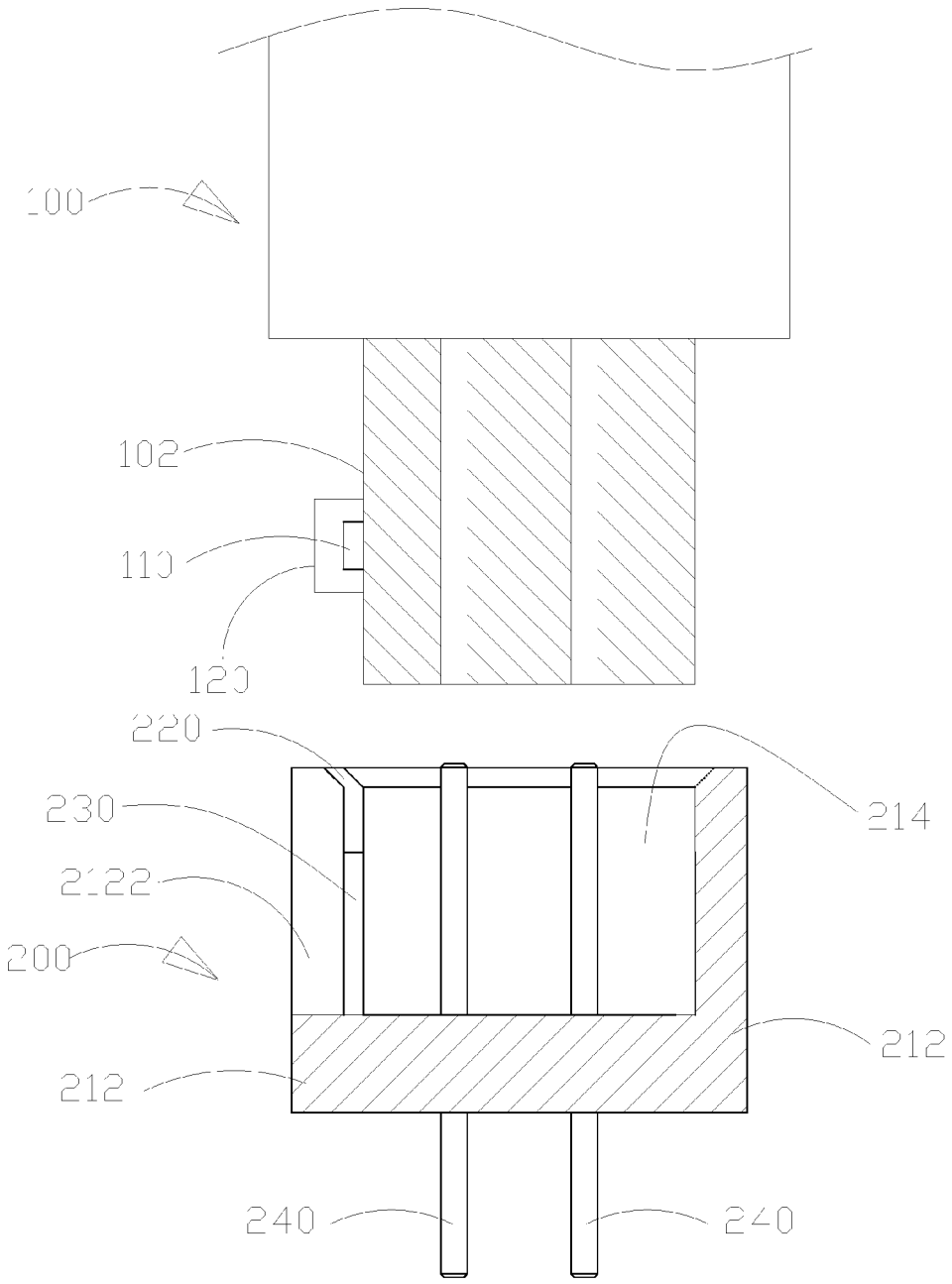
FIGS. 3A-3C schematically show in sequence how the connecting terminal is connected to the electric socket in the first preferred embodiment of the invention.
Figure 3B:
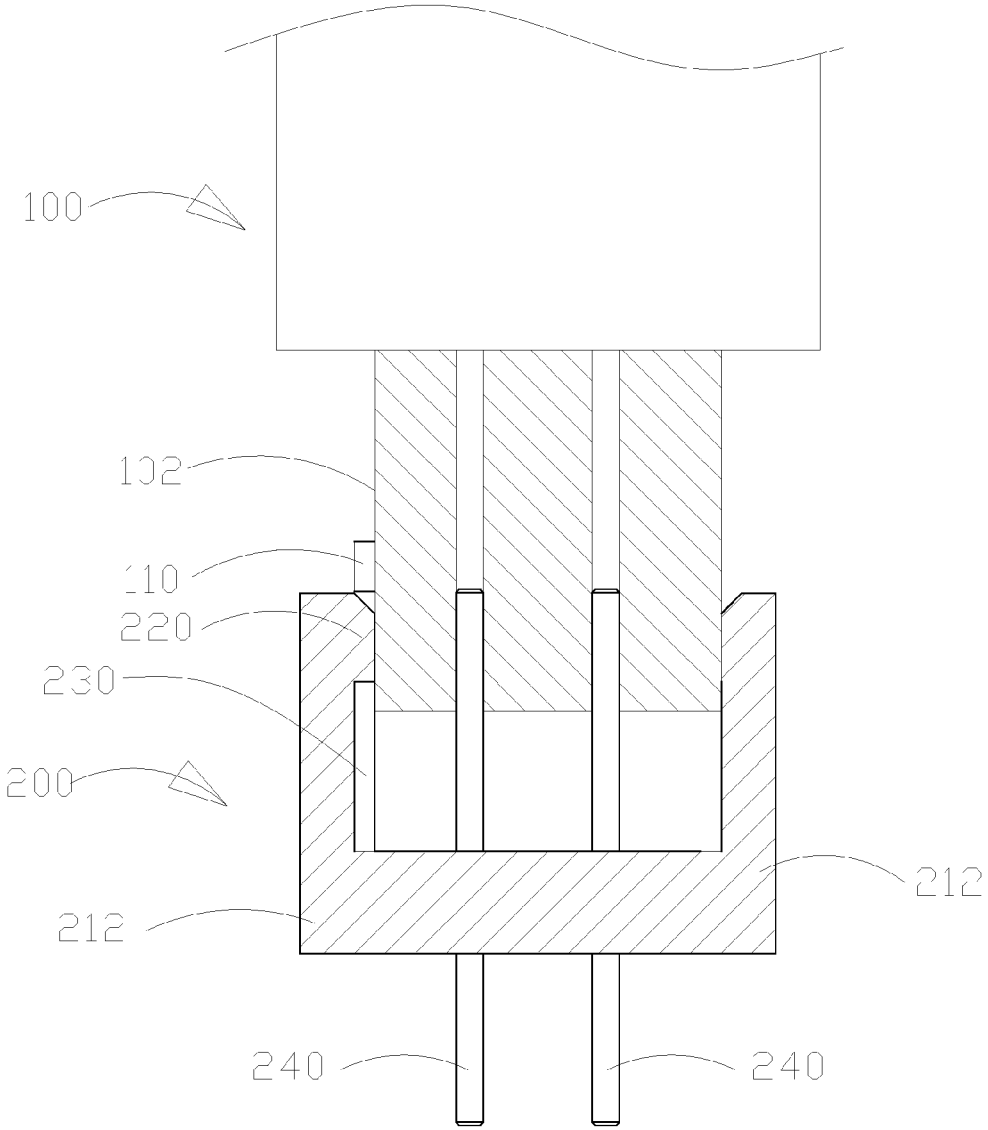
Figure 3C:
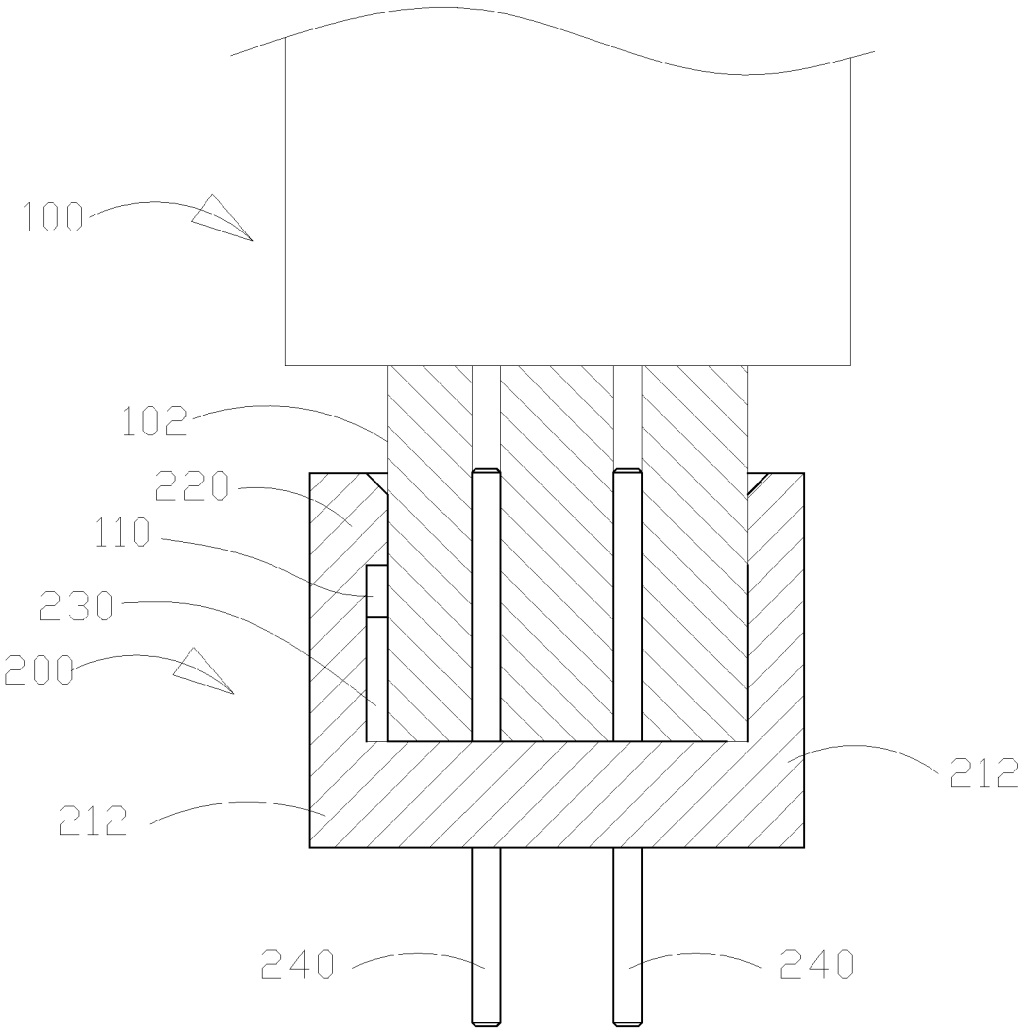

FIGS. 3A-3C schematically show in sequence how the connecting terminal is connected to the electric socket in the first preferred embodiment of the invention. As shown in FIG. 3A, when the connecting terminal 100 is connected to the housing 210, the guide bump 120 slides into the recess 2122, the conductive pins 240 are plugged into the connecting terminal 100, and the rib 230 opposes against the outer surface 102 of the connecting terminal 100, so that the connecting terminal 100 may be fixed by an active force from the sidewall 212 (see FIG. 3B). The contact area of the sidewall 212 with the outer surface 102 of the connecting terminal 100 may be increased by means of the rib 230. In this way, friction between the sidewall 212 and the connecting terminal 100 is increased, thereby avoiding the loose connection, slip, or detachment of the connecting terminal 100 from the electric socket 200.

Once the connecting terminal 100 is pushed down to the end, as shown in FIG. 3C, the conductive pins 240 will electrically connect thereto, and the baffled portion 220 will oppose against the fastener 110. Users may judge whether or not the connecting terminal 100 is connected firmly with the electric socket 200 from the baffled portion 220.

Figure 4:
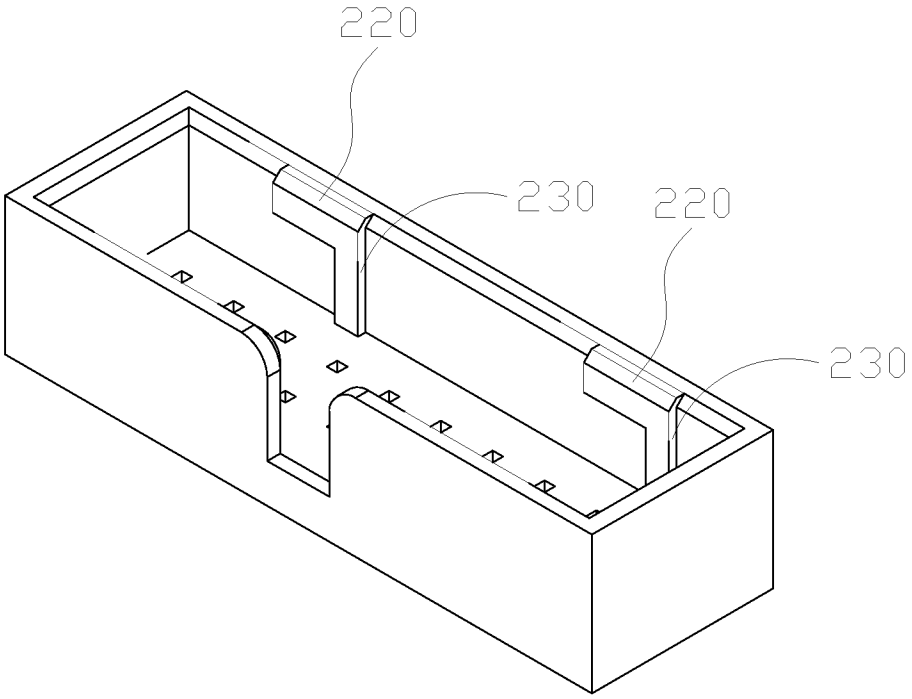
FIG. 4 is a three-dimensional view showing a bearing body of the electric socket in a second preferred embodiment of the invention.

FIG. 4 is a three-dimensional view showing the bearing body of the electric socket in a second preferred embodiment of the invention. As observed from this figure, the bearing body in this embodiment is different from that in the first embodiment (FIG. 2A) in that the rib 230 is formed integrally with the baffled portion 220. The fact that the rib 230 and the baffled portion 220 are formed integrally may increase the area of the rib 230. It is helpful in increasing the friction between the rib 230 and the connecting terminal 100, so the slip, loose connection, or detachment of the connecting terminal 100 can be prevented effectively.

Figure 5:
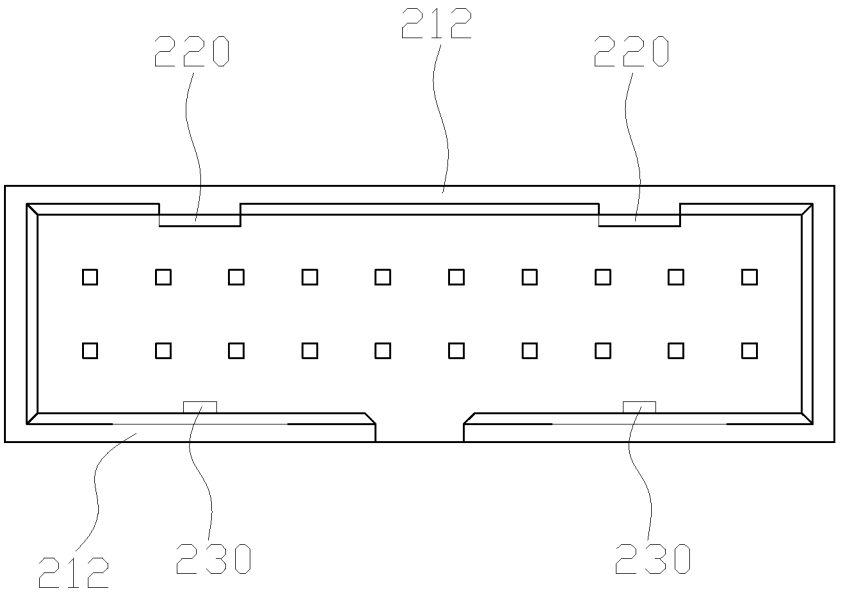
FIG. 5 is a top view showing the bearing body of the electric socket in a third preferred embodiment of the invention.

FIG. 5 is a top view showing the bearing body of the electric socket in a third preferred embodiment of the invention. As seen from this figure, the bearing body in this embodiment is different from that in the second embodiment (FIG. 2B) in that the rib 230 is opposite rather than next to the baffled portion 220. Once the connecting terminal 100 is plugged into the electric socket 200, the baffled portion 220 will push the outer surface 102 of the connecting terminal 100. Therefore, the connecting terminal 100 can be more tightly gripped by the sidewall 212 when the rib 230 is located opposite to the baffled portion 220.

Figure 6A:
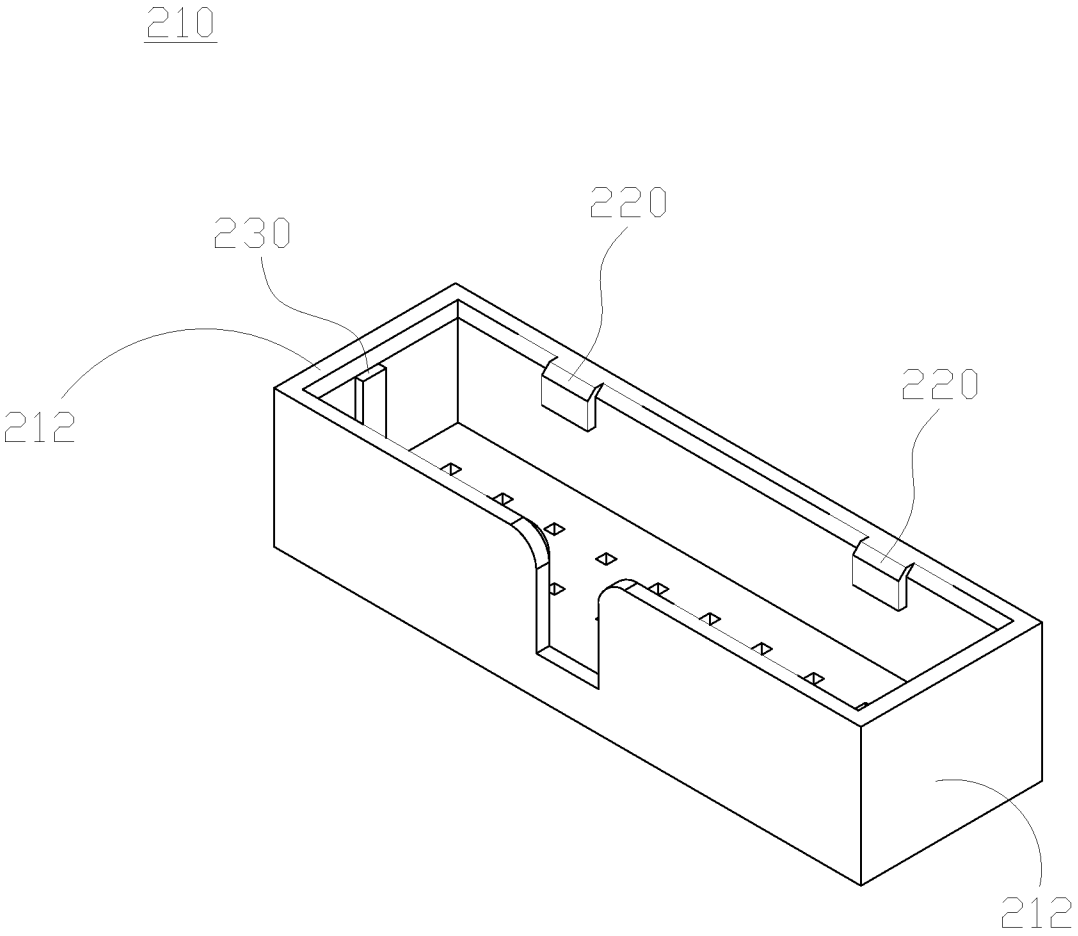
FIG. 6A is a three-dimensional view showing the bearing body of the electric socket in a forth preferred embodiment of the invention.
Figure 6B:
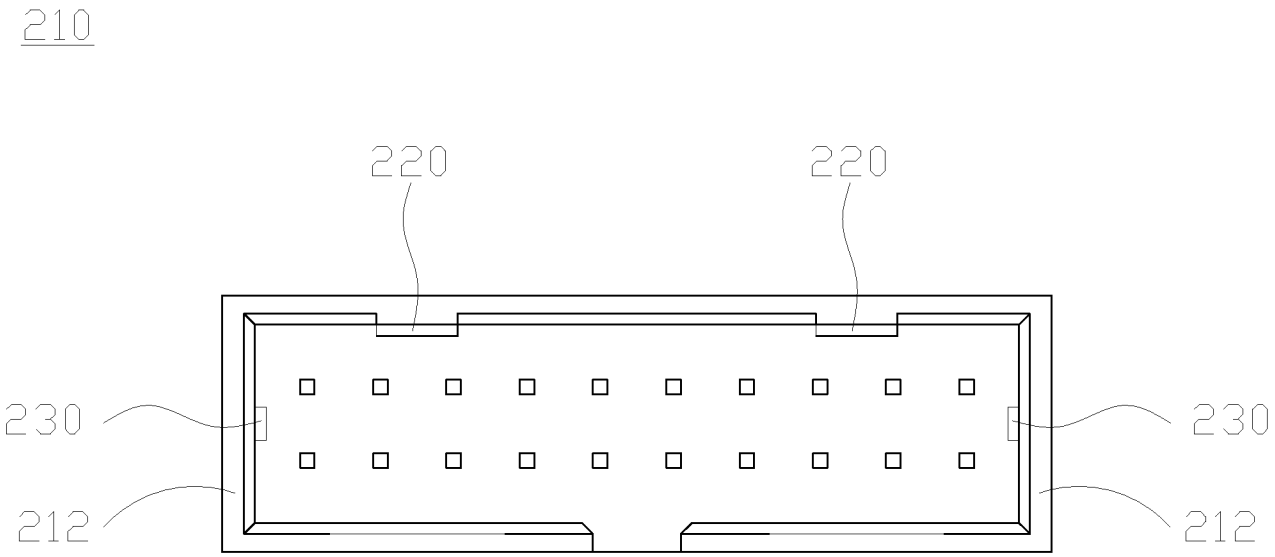
FIG. 6B is a top view showing the bearing body of the electric socket in the forth preferred embodiment of the invention.

FIGS. 6A and 6B are respectively a three-dimensional view and a top view showing the bearing body for the electric socket in a forth preferred embodiment of the invention. Similarly, the bearing body in this embodiment is different from that in the third embodiment (FIG. 5) in the position of the rib 230. This embodiment takes two ribs 230 for illustration. Two ribs 230 are disposed longitudinally and separately from each other on two opposite sidewalls on which the baffled portions 220 are not located. In addition to the baffled portions 220, the ribs 230 at both sides may also secure the connecting terminals 100 to further prevent the sway thereof.

Figure 7A:
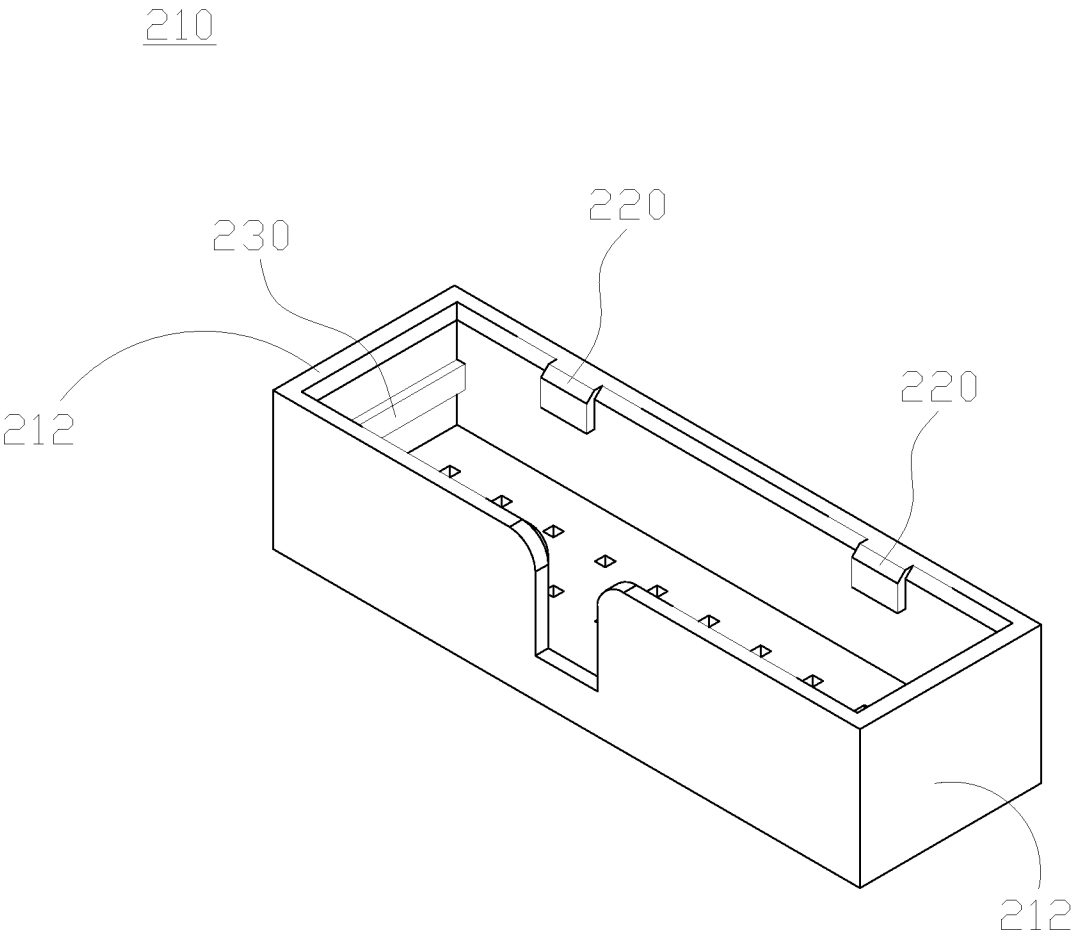
FIG. 7A is a three-dimensional view showing the bearing body of the electric socket in a fifth preferred embodiment of the invention.
Figure 7B:
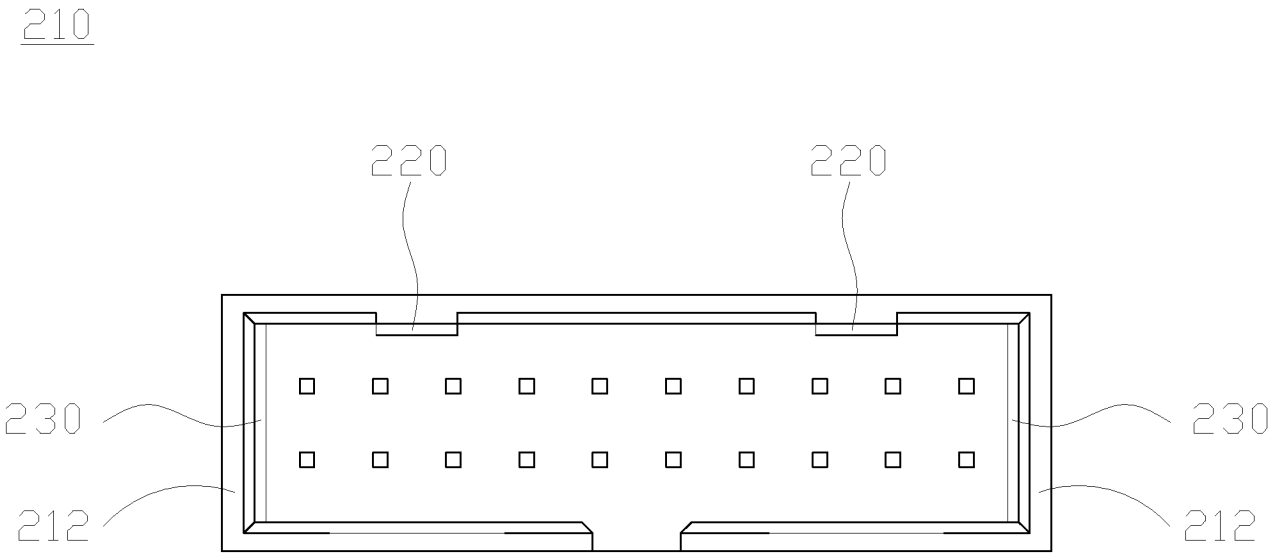
FIG. 7B is a top view showing the bearing body of the electric socket in the fifth preferred embodiment of the invention.

FIGS. 7A and 7B are respectively a three-dimensional view and a top view showing the bearing body for the electric socket in a fifth preferred embodiment of the invention. The bearing body in this embodiment is different from that in the forth embodiment (FIGS. 6A and 6B) in the arrangement of the rib 230. As shown in FIGS. 7A and 7B, two ribs 230 are disposed substantially laterally and separately from each other on two opposite sidewalls on which the baffled portions 220 are not located. Such an arrangement of the ribs 230 is also helpful in securing firmly the electric socket 200 together with the connecting terminal 100.

Alternatively, the two ribs 230 may be disposed in an arbitrary direction from the upper side to the lower side of the two opposite sidewalls on which the baffled portions 220 are not located. Similarly, it is also helpful in securing firmly the electric socket 200 together with the connecting terminal 100 as in the above embodiments.

Figure 8A:
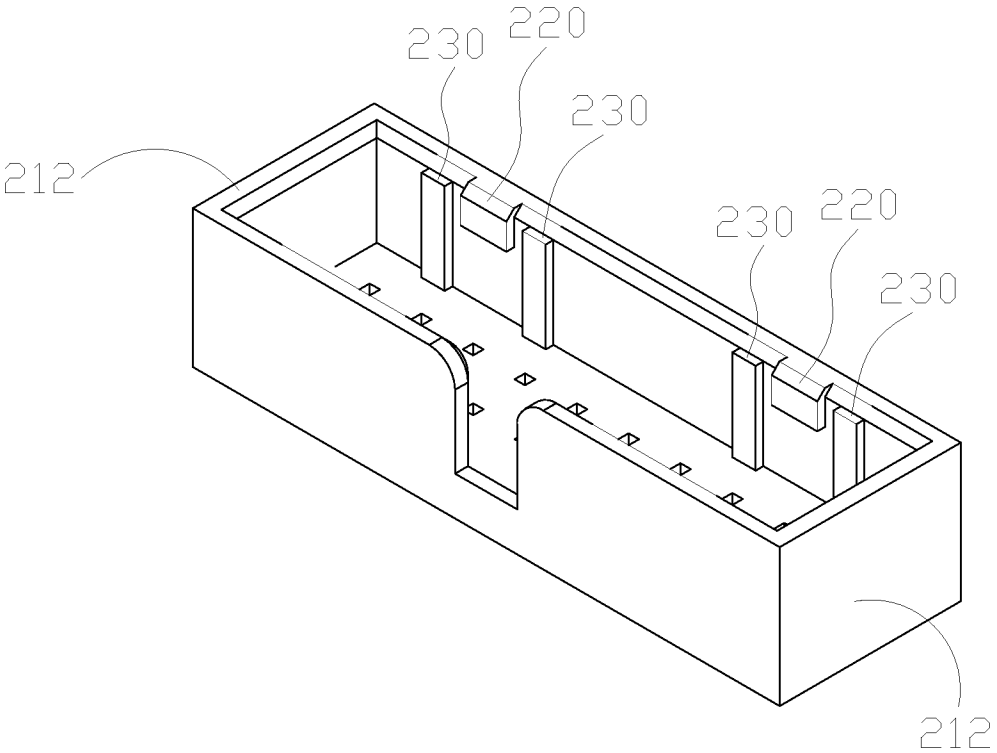
FIG. 8A is a three-dimensional view showing the bearing body of the electric socket in a sixth preferred embodiment of the invention.
Figure 8B:
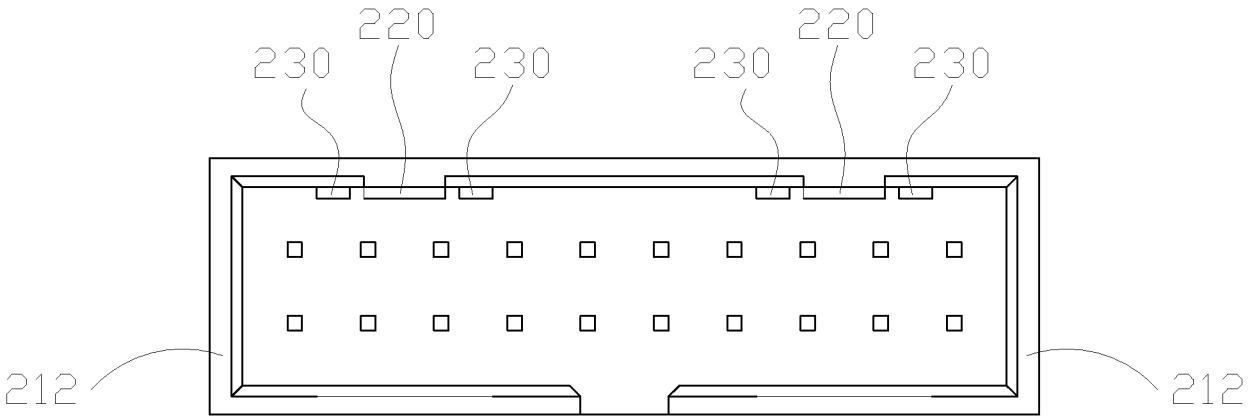
FIG. 8B is a top view showing the bearing body of the electric socket in the sixth preferred embodiment of the invention.

FIGS. 8A and 8B are respectively a three-dimensional view and a top view showing the bearing body for the electric socket in a sixth preferred embodiment of the invention. As shown in the figures, this embodiment is different from the first embodiment (FIG. 2B) in that a plurality of the ribs 230 are only disposed at both sides of the respective baffled portions 220. The friction between the connecting terminal 100 and the sidewall 212 is increased owing to the increased contact area of the both. Thus, the slip, loose connection, or detachment of the connecting terminal 100 can be prevented effectively.

Figure 9A:
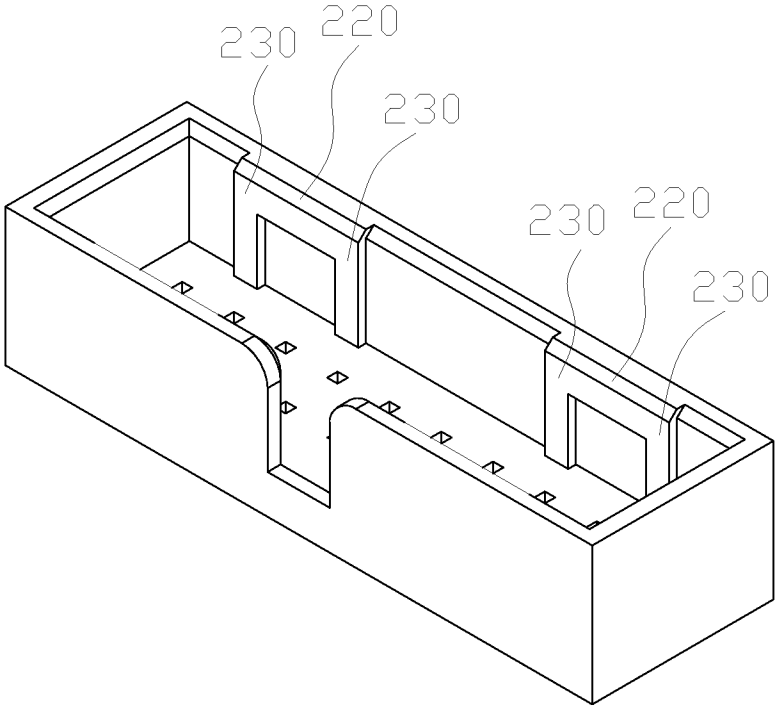
FIG. 9A is a three-dimensional view showing the bearing body of the electric socket in a seventh preferred embodiment of the invention.
Figure 9B:
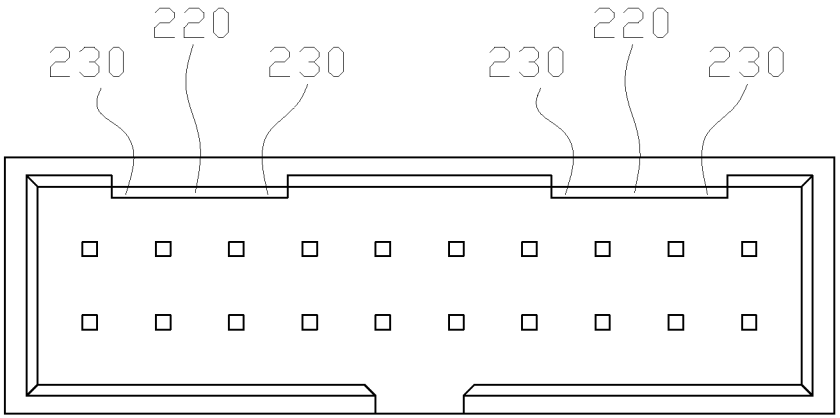
FIG. 9B is a top view showing the bearing body of the electric socket in the seventh preferred embodiment of the invention.

FIGS. 9A and 9B are respectively a three-dimensional view and a top view showing the bearing body for the electric socket in a seventh preferred embodiment of the invention. As shown in the figures, this embodiment is different from the sixth embodiment (FIGS. 8A and 8B) in that the baffled portions 220 and the ribs 230 are formed integrally instead of separately. The friction between the connecting terminal 100 and the sidewall 212 is increased more by means of such configuration because of the more contact area compared with the sixth embodiment.

Figure 10:
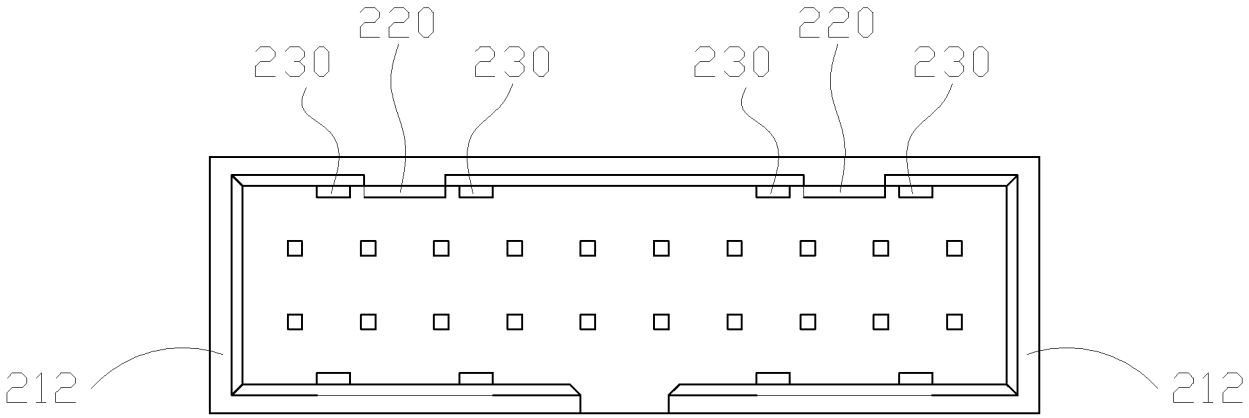
FIG. 10 is a top view showing the bearing body of the electric socket in an eighth preferred embodiment of the invention.

FIG. 10 is a top view showing the bearing body for the electric socket in an eighth preferred embodiment of the invention. As shown in the figure, this embodiment is different from the seventh embodiment (FIGS. 9A and 9B) in that the additional ribs 230 are disposed on the sidewall 212 opposite to where the baffled portions 220 are provided, at the position facing the ribs 230 at both sides of the respective baffled portions 220. In this way, the housing 210 is provided with ribs 230 on two opposite sidewalls thereof. The plurality of ribs are advantageous in increasing the friction by increasing the contact area of the sidewall 212 and the outer surface 102 of the connecting terminal 100, thereby preventing loose connection, slip, or detachment of the connecting terminal 100.

Figure 11A:
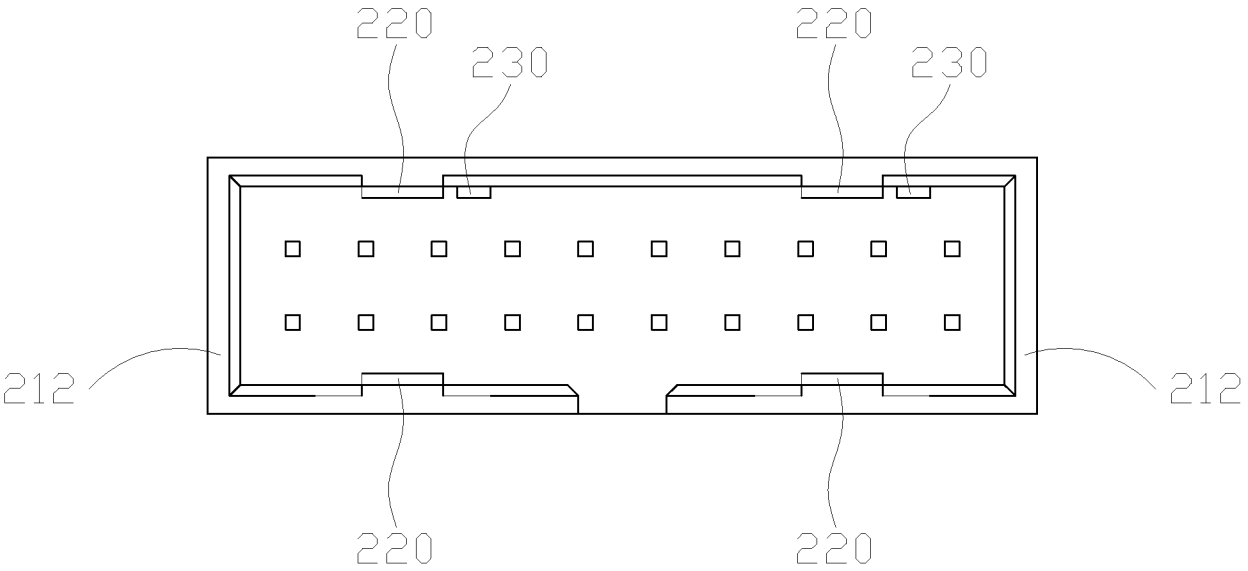
FIG. 11A is a top view showing the bearing body of the electric socket in a ninth preferred embodiment of the invention.
Figure 11B:
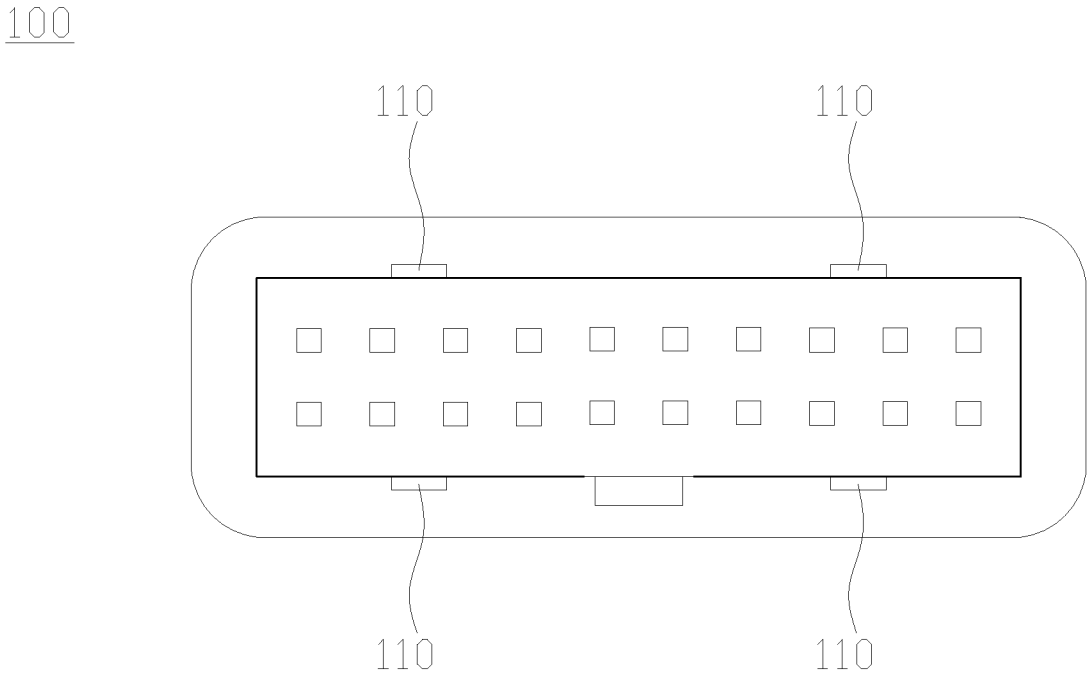
FIG. 11B is a top view showing the connecting terminal in the ninth preferred embodiment of the invention.

FIGS. 11A and 11B are respectively top views showing the bearing body for the electric socket and the connecting terminal in a ninth preferred embodiment of the invention. Comparing with the bearing body of FIG. 2C, four baffled portions 220 are provided in this embodiment, and four fasteners 110 are provided correspondingly on the outer surface 102 of the connecting terminal 100. In brief, this embodiment prevents loose connection, slip, or detachment of the connecting terminal 100 more effectively by providing more baffled portions together with corresponding fasteners.

Figure 12:
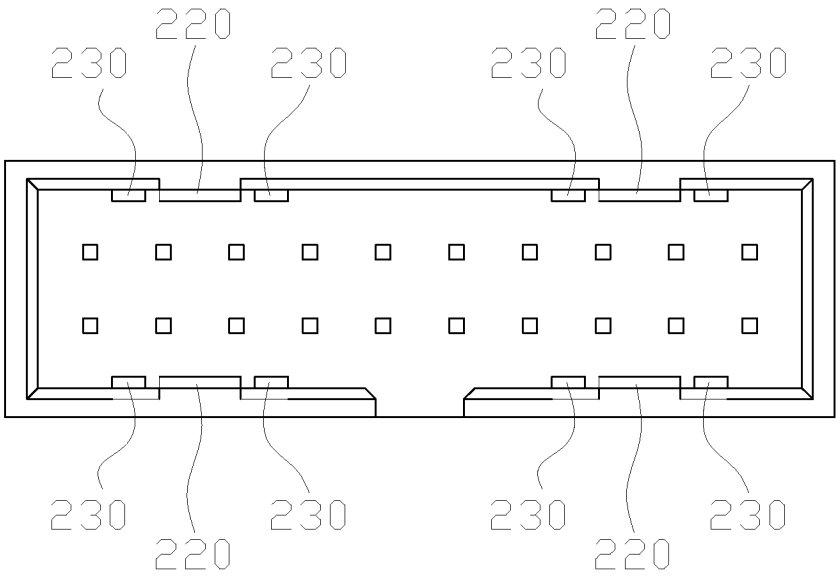
FIG. 12 is a top view showing the bearing body of the electric socket in a tenth preferred embodiment of the invention.

FIG. 12 is a top view showing the bearing body for the electric socket in an tenth preferred embodiment of the invention. As shown in the figure, this embodiment is different from the ninth embodiment (FIG. 11A) in that ribs 230 are provided at both sides of each of the four baffled portions 220. Thus, the former has a larger contact area between the ribs 230 and the connecting terminal 100 compared with the latter. As expected, loose connection, slip, or detachment of the connecting terminal 100 can be prevented more effectively in the former. Preferably, the ribs 230 are formed integrally with the baffled portions 220. The fact that the rib 230 and the baffled portion 220 are formed integrally may increase the contact area of the rib 230 and connecting terminal 100.

Figure 13:
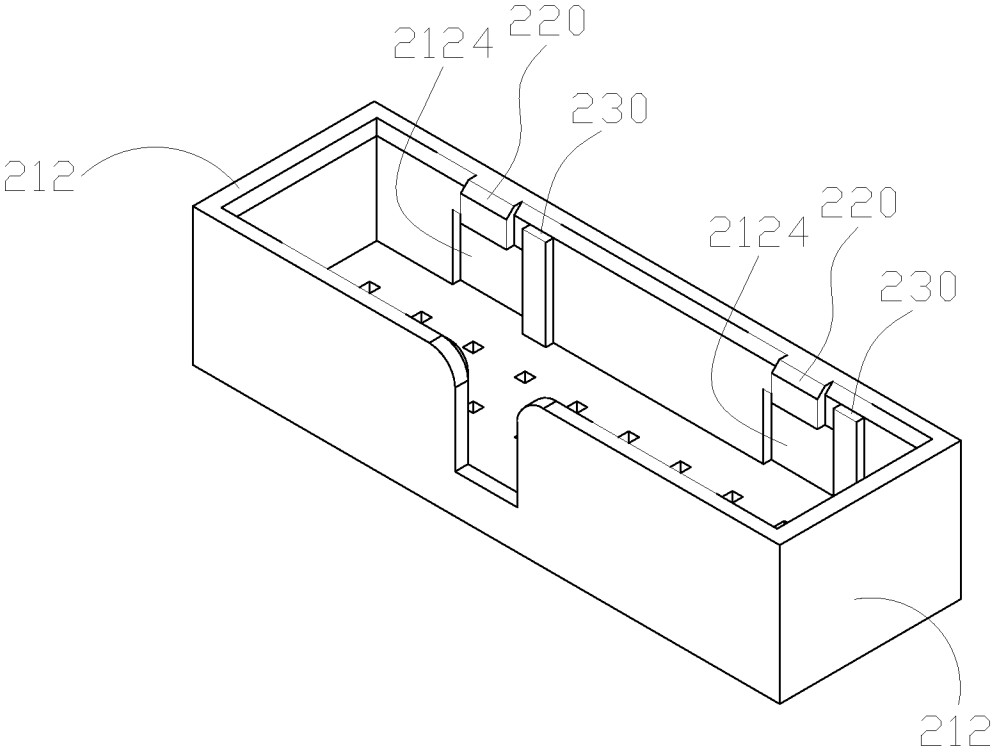
FIG. 13 is a top view showing the bearing body of the electric socket in an eleventh preferred embodiment of the invention.

FIG. 13 is a top view showing the bearing body for the electric socket in an eleventh preferred embodiment of the invention. As shown in the figure, this embodiment is different from the first embodiment (FIG. 2B) in that a depression 2124 is formed on a sidewall 212 and the baffled portion 220 is adjacent thereto. Two depressions are exemplified in this embodiment, while the number of the depressions may be determined as needed. When the connecting terminal 100 is combined with the electric socket 200, the baffled portion 110 will be lodged in the depression 2124. As a result, loose connection, slip, or detachment of the connecting terminal 100 can be deterred effectively by a strong combination between the baffled portion 110 and sidewall 212. From the above description of the invention, it is manifest that various techniques can be used for implementing the concepts of the invention without departing from the scope thereof. Moreover, while the invention has been described with specific reference to certain embodiments, a person of ordinary skills in the art would recognize that changes can be made in form and detail without departing from the spirit and the scope of the invention. The described embodiments are to be considered in all respects as illustrative and not restrictive. It is intended that the scope of the invention is defined by the appended claims.

What is claimed is:

1. An electric socket for an electrically connecting terminal, the electrically connecting terminal having a fastener and a guide bump on an outer surface thereof, the electric socket comprising:

a housing having a plurality of sidewalls and a bottom, the housing accommodating the electrically connecting terminal;

a baffled portion located on a first sidewall of the sidewalls corresponding to the fastener and configured to be engaged with the fastener;

a plurality of ribs, one of the ribs provided on a third sidewall that is adjoining to the first sidewall, the rib extending longitudinally from one side to the other side of the third sidewall, and a portion of at least another one of the plurality of ribs disposed respectively on each of the first sidewall and the second sidewall opposite thereto, and the surface area of the ribs on the first sidewall and the second sidewall project from a plane of the respective sidewall to oppose against the outer surface of the electrically connecting terminal; and a plurality of conductive pins penetrating the bottom and electrically connecting to the electrically connecting terminal.

2. The electric socket according to the claim 1, wherein the housing further comprises a recess on the first sidewall, the fastener of the electrically connecting terminal is lodged in the recess, and the recess is adjacent to the baffled portion.

3. The electric socket according to the claim 1, wherein the one of the ribs is adjacent to the baffled portion.

4. The electric socket according to the claim 3, wherein the baffled portion and the one of the ribs are formed integrally.

5. The electric socket according to the claim 1, wherein an indentation is formed on the second sidewall of the housing, through which the guide bump is accommodated on the second sidewall.

6. A bearing body of an electric socket, comprising:

a housing having a plurality of sidewalls and a bottom, the housing accommodating an electrically connecting terminal;

a baffled portion on a first sidewall of the plurality of the sidewalls; and a plurality of ribs, one of the ribs provided on a third sidewall of the sidewalls that is adjoining to the first sidewall, the rib extending longitudinally from one side to the other side of third sidewall, a portion of at least another one of the plurality of ribs disposed respectively on each of the first sidewall and the second sidewall opposite thereto, and the surface area of the ribs on the first sidewall and the second sidewall project from a plane of the respective sidewall to oppose against the outer surface of the electrically connecting terminal.

7. The bearing body for an electric socket according to claim 6, wherein the housing comprises an indentation on the second sidewall.

8. The bearing body for an electric socket according to claim 6, wherein the housing further comprises a recess adjacent to the baffled portion on the first sidewall.

9. The bearing body for an electric socket according to claim 6, wherein the one of the ribs is adjacent to the baffled portion.

10. The bearing body for an electrically connecting terminal according to claim 9, wherein the baffled portion and the one of the ribs are formed integrally.

* * * * *